United States Patent [19]

Duarte

[11] Patent Number: 5,009,160

[45] Date of Patent: Apr. 23, 1991

[54] TRANSFER CYLINDER FOR PRINTING PRESS

[76] Inventor: Eduardo Duarte, 528 Rawls Cir., Irving, Tex. 75061

[21] Appl. No.: 400,694

[22] Filed: Aug. 30, 1989

Related U.S. Application Data

[63] Continuation-in-part of Ser. No. 191,322, May 9, 1989, Pat. No. 4,967,661, which is a continuation-in-part of Ser. No. 58,892, Jun. 5, 1987, Pat. No. 4,836,104.

[51] Int. Cl.[5] ..... B41F 13/08

[52] U.S. Cl. ..... 101/422; 427/393.1; 427/412.5

[58] Field of Search ..... 101/422, 420, 416.1; 427/393.1, 412.5; 428/412, 447

[56] References Cited

U.S. PATENT DOCUMENTS

| | | | |
|---|---|---|---|
| 1,201,788 | 10/1916 | Yetter | 101/420 X |
| 2,232,989 | 2/1941 | Wooddell | 101/422 X |
| 3,258,358 | 6/1966 | Cohen | 427/393.1 X |
| 3,308,522 | 3/1967 | Miller | 29/120 |
| 3,423,314 | 1/1969 | Campbell | 427/393.1 X |
| 3,597,146 | 8/1971 | Tesoro | 427/393.1 X |
| 3,791,644 | 2/1974 | DeMoore | 101/422 X |
| 4,242,959 | 1/1981 | Jeschke et al. | 101/420 |
| 4,310,600 | 1/1982 | Cross | 428/447 |
| 4,371,585 | 2/1983 | Memon | 427/413.5 X |
| 4,402,267 | 9/1983 | DeMoore | 101/422 X |
| 4,665,823 | 5/1987 | Hightower | 101/420 X |
| 4,786,558 | 11/1988 | Sumiya et al. | 428/412 X |
| 4,836,104 | 6/1989 | Duarte | 101/420 |

FOREIGN PATENT DOCUMENTS

| | | | |
|---|---|---|---|
| 261143 | 6/1913 | Fed. Rep. of Germany | 101/420 |
| 179796 | 8/1986 | Japan | 101/422 |
| 2177413 | 1/1987 | United Kingdom | 427/393.1 |

OTHER PUBLICATIONS

Lexan Polycarbonate Film Sample, Matte/Suede Surface Finish, Designation 8B36.

GE Lexan Film Brochure SP994 (5/87) RTB.

GE Lexan Polycarbonate Films Technical Manual SP-811 (4/83) JF.

VARN label for Silicone Spray.

*Primary Examiner*—Clifford D. Crowder

*Attorney, Agent, or Firm*—Crutsinger & Booth

[57] ABSTRACT

A transfer cylinder for a printing press having a film of polycarbonate bonded to the surface. The film has a matte surface over which a film of silicone is applied.

16 Claims, 3 Drawing Sheets

TRANSFER CYLINDER FOR PRINTING PRESS

CROSS REFERENCE TO RELATED APPLICATIONS

This application is a continuation-in-part of application Ser. No. 07/191,322, filed May 9, 1989 entitled Sheet Transfer Mechanism for Printing Press, now U.S. Pat. No. 4,967,661, which is a continuation-in-part of application Ser. No. 07/058,892, filed June 5, 1987, now U.S. Pat. No. 4,836,104 which issued June 6, 1989.

TECHNICAL FIELD

The disclosed invention relates to a method and apparatus for transferring freshly printed sheets between printing stations in a printing press.

BACKGROUND OF THE INVENTION

Skeleton wheels and transfer cylinders are conventionally employed in printing presses for conveying freshly printed sheets from the impression cylinder of one printing station to the impression cylinder of a subsequent printing station. Sheets are often "marked" when the printed side of freshly printed surfaces contact surfaces of skeleton wheels and transfer cylinders.

A variety of surface 8 configurations and coverings have been proposed to reduce marking of sheets traveling through a printing press. The sheet transfer mechanism disclosed in U.S. Pat. No. 4,836,104 efficiently and effectively controls the path of the travel of a freshly printed sheet. However, in certain applications it is necessary to completely remove existing transfer cylinders and skeleton wheels for retro-fitting an existing printing press. A need persists for a suitable covering for existing skeleton wheels and transfer cylinders to prevent marking of sheets. U.S. Pat. No. 3,308,522 discloses an anti-offset roll having a ribbon of fabric having pile loops spirally wound about and secured to the surface of the cylinder.

U.S. Pat. No. 4,694,750 discloses a transfer cylinder having granular particles on the surface thereof in combination with elastic members having hooks on the end thereof adjustably secured around the circumference of the transfer cylinder and movable to positions longitudinally of the transfer cylinder most advantageous for the particular printing job.

U.S. Pat. No. 3,791,644 discloses a skeleton wheel for a printing press having an ink repellant, circumferential surface formed of polytetrafluoroethylene ("Teflon," a registered trademark). The first embodiment of the skeleton wheel is described as being wider than prior art thin-disc skeleton wheels having a plurality of very narrow, circumferentially spaced grooved projections for engaging a printed sheet. The first embodiment employed for example five skeleton wheels, each approximately four inches in width adjustable longitudinally of a delivery shaft to permit spacing of the wheels to engage the sheet in non-image areas. A second embodiment of the "Teflon" coated skeleton wheel is described as extending substantially the full width of the printing press.

U.S. Pat. No. 4,402,267 states that the "Teflon" coated wheel disclosed in U.S. Pat. No. 3,791,644, with continuous use over a period of time, experienced a slight accumulation of ink on the surface of the wheel. In an effort to overcome this problem, a layer of relatively loose-weave woven fabric gauze having a 40 count or 40 mesh was treated with a fabric softener commercially available under the trademark "DOWNEY" and with a fabric protector commercially available under the trademark "SCOTCH GUARD." The piece of fabric gauze is attached loosely around the surface of the skeleton wheel to permit and accommodate slight movement between the fabric and the surface of the skeleton wheel where the printed sheet is supported and conveyed by the skeleton wheel. However, when the fabric gauze picks-up and accumulates wet ink, it must be replaced since it cannot be cleaned or reconditioned while on the skeleton wheel.

U.S. Pat. No. 4,242,959 discloses a transfer drum provided with sheet carrying elements extending circumferentially around a transfer drum and spaced longitudinally of the drum, the sheet carrier elements being pivotable through 90° into and out of a sheet engaging position.

SUMMARY OF INVENTION

A covering for a transfer cylinder for a printing press is disclosed. Polycarbonate film is bonded to the surface of the transfer cylinder, the film having a "suede" textured surface and a "matte" textured surface. The "suede" textured surface is bonded to the surface of the transfer cylinder and a film of silicone is applied on the "matte" textured surface of the film to form a slick ink repellant "matte" textured surface.

DESCRIPTION OF DRAWINGS

Drawings of a preferred embodiment of the invention are annexed hereto, in which.

Numeral references are employed to designate like parts throughout the various figures of the drawing.

DESCRIPTION OF A PREFERRED EMBODIMENT

Figure 1:
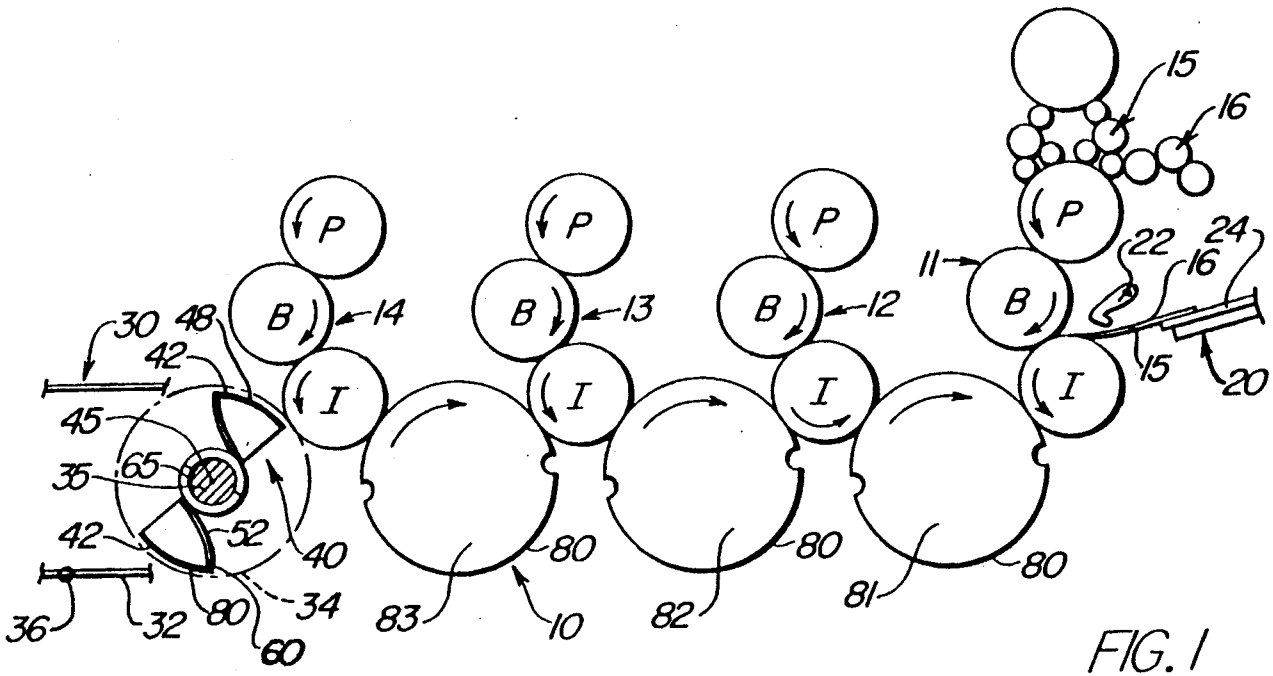
FIG. 1 is a diagrammatic view of rollers in a lithographic offset printing press, in which one transfer cylinder is employed between printing stations.

Referring to FIG. 1 of the drawing, the numeral 10 generally designates a printing press which in the illustrated embodiment comprises a multi-color, sheet-fed, lithographic offset printing press. Printing press 10 comprises printing stations 11, 12, 13 and 14, each of the printing stations having a plate cylinder P, blanket cylinder B and an impression cylinder I.

Each printing station 11, 12, 13 and 14 is of conventional design and forms no part of the invention except in combination with the transfer cylinders as will be hereinafter more fully explained.

Each printing station is conventionally equipped with an inker 15 and dampener 16 for applying ink and dampening fluid to a lithographic printing plate on plate cylinder P. An image is printed from the printing plate to the surface of a blanket on blanket cylinder B and is offset onto the surface of a sheet carried through the nip between impression cylinder I and blanket cylinder B.

A sheet feeder generally designated by the numeral 20 in FIG. 1 of the drawing is provided with a swing gripper 22 for feeding sheets from a feeder board 24 to a gripper mechanism 26 on the impression cylinder I of the first printing station 11.

As will be hereinafter more fully explained, after a sheet has moved through each of the printing stations the printed sheet is removed from the impression cylinder I in printing station 14 by a sheet delivery mechanism 30 comprising a pair of chains 32 driven by spaced sprockets 34 mounted on a shaft 35 which is rotatable about an axis 45.

A sheet guide member generally designated by the numeral 40 in FIG. 1 of the drawing is preferably of the type disclosed in U.S. Pat. No. 4,836,104 and in my co-pending U.S. Pat. No. 4,967,661, the disclosures of which are incorporated herein by reference in their entireties for all purposes.

The printing press 10 illustrated in FIG. 1 of the drawing is provided with single transfer cylinders 81, 82 and 83 for transferring sheets between printing stations 11, 12 and 13. The printing press illustrated in FIG. 2 of the drawing is provided with multiple transfer cylinders between printing stations. A sheet printed in the first printing station 11 is transferred by transfer cylinders 84, 81' and 85 to the second printing station 12. The printed sheet is transferred from the second printing station by transfer cylinders 86, 82' and 87 to the third printing station 13. The printed sheet is transferred from the third printing station 13 by transfer cylinders 88, 83' and 89 to the fourth printing station 14.

Referring to FIG. 1 of the drawing, it should be readily apparent that the wet side of a sheet which has been printed by the blanket cylinder in the first printing tower 11 at the nip between blanket cylinder B and impression cylinder I engages the surface of transfer cylinder 81 while it is being carried by transfer cylinder 81 to the second printing station 12. The wet side of the printed sheet contacts surfaces of transfer cylinders 82 and 83 as the sheet is moved through the printing press.

Figure 3:
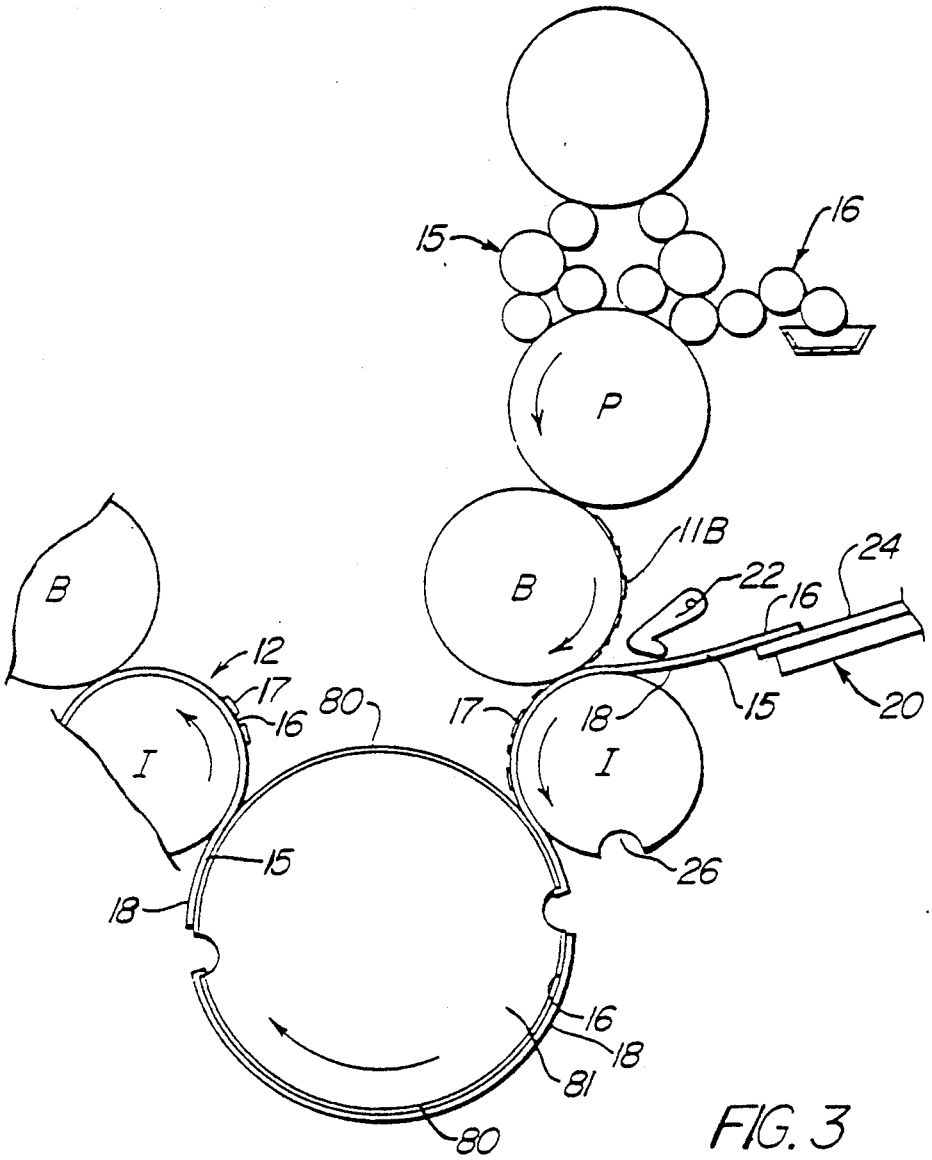
FIG. 3 is an enlarged diagrammatic view of rollers in one printing station.

As diagrammatically illustrated in FIG. 3, the image 11*b* formed on the blanket on the blanket cylinder B of the first printing station 11 contact the exposed surface 16 of sheet 15 and forms an image 17 of wet ink on the surface of the sheet. The backside 18 of the sheet is not printed in a particular configuration of the printing press illustrated in FIGS. 1 and 3 of the drawing.

Figure 2:
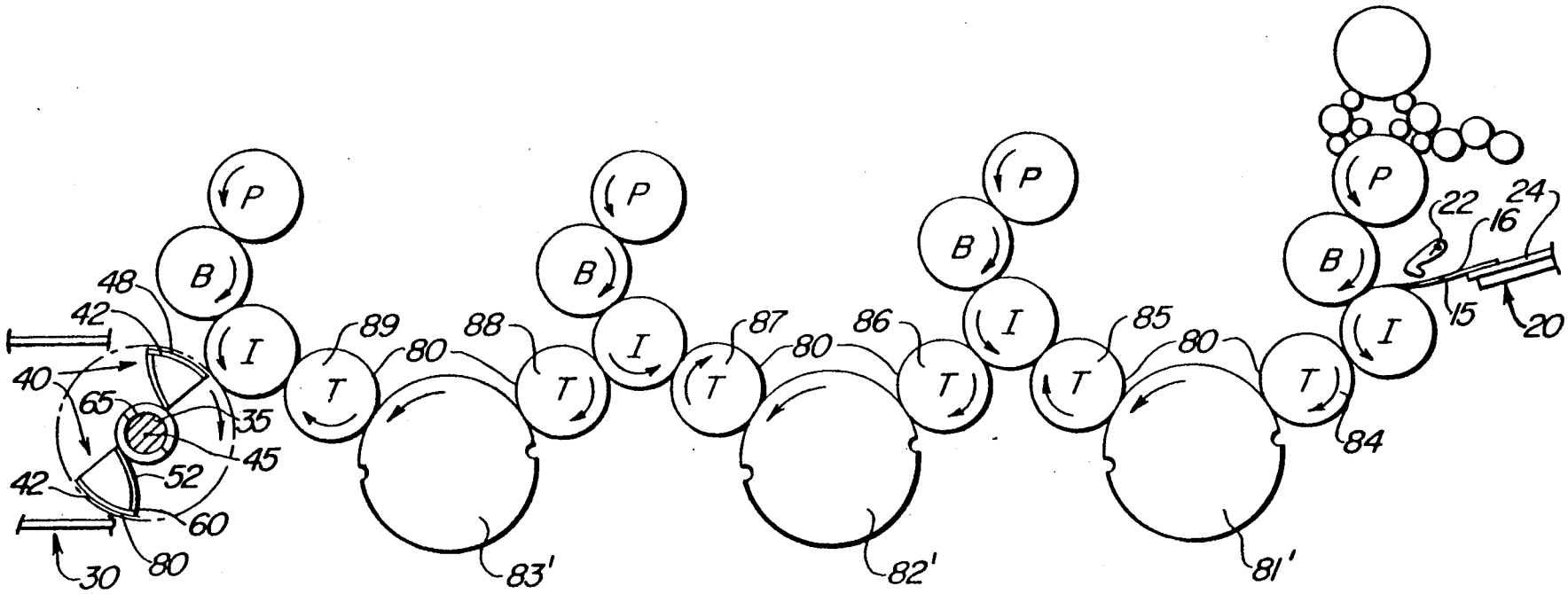
FIG. 2 is a diagrammatic view of rollers in a lithographic offset printing press, in which several transfer cylinders are employed between printing stations.

In the embodiment of the printing press illustrated in FIG. 2 of the drawing, the wet image 17 on sheet 15 contacts a surface of transfer cylinder 84 and the surface of transfer cylinder 85. However, the unprinted backside 18 of sheet 15 contacts transfer cylinders 81', 82' and 83'. A film 80 having a surface condition to reject wet printing ink is applied to the surface of the transfer cylinders which are engaged by the wet image 17 on sheets 15. In the form of the invention illustrated in FIG. 1 of the drawing, covering 80 is applied to transfer cylinders 81, 82 and 83. In the printing press illustrated in FIG. 2 of the drawing, cover 80 is applied to transfer cylinders 84, 85, 86, 87, 88 and 89. However, since the wet ink 17 does not engage transfer cylinders 81', 82' and 83', covering 80 is not applied to these cylinders.

A sheet transfer mechanism, generally designated by the numeral 30 in FIGS. 1 and 2 of the drawing, may assume a variety of configurations. The illustrated embodiment of sheet transfer mechanism 30 comprises a pair of chains 32 carrying gripper bars 36 which are driven by sprockets 34 mounted on a shaft 35 which is rotatable about an axis 45. Conventional skeleton wheels and transfer cylinders heretofore devised have been mounted on shaft 35 and have had a radius of curvatures substantially equal to the pitch line of gear 34. The freshly printed surface 17 on sheet 15 physically contacted surfaces of the skeleton wheels and transfer cylinders which caused the freshly printed ink to be applied to the skeleton wheel or transfer cylinder.

The pitch diameter of sprocket 34 is illustrated in dashed outline in FIG. 1 and FIG. 2.

Details of construction of the sheet guide member generally designated by the numeral 40 in FIGS. 1 and 2 of the drawing are disclosed in U.S. Pat. No. 4,836,104 and my co-pending U.S. Pat. No. 4,967,661. Guide members 40 are mounted on shaft 35 and rotate about axis 45. Referring to FIGS. 1 and 2 of the drawing, sheet guide member 40 comprises an arcuate guide segment 42 and a vane 52 secured to a spoke. The upper portion of the spoke extends between guide segment 42 and vane 52 and has a hub 65 formed on the end thereof.

The arcuate guide segment 52 has a leading edge and a trailing edge with a curved outer guide surface 48 extending therebetween. Vane 52 has a leading edge and a trailing edge and is spaced from vane 52 to form a chamber between guide segment 42 and vane 52. Trailing edges of guide segment 42 and vane 52 are closely spaced to form an air dispensing passage 60 therebetween. The cross section of the chamber diminishes from an entrance opening toward the air dispensing passage 60 such that a stream of high velocity air flows through the dispensing passage 60 to impinge against the freshly printed surface 17 on sheet 15. Film 80 is applied to guide surface 48 of the arcuate guide member 42 to form a slick "matte" textured ink resistant surface thereon.

Transfer cylinders 81, 82 and 83 are preferably provided with a film of polycarbonate film of thin-gauged extruded material which is commercially available from General Electric Plastics of Pittsfield, Mass. under the registered trademark "LEXAN" film. A suitable material is textured, graphic arts "LEXAN" film designation 8B36. The film has a matte/suede surface finish and a gauge of 0.010–0.020 inches.

LEXAN film has been used heretofore for forming back-lighted signs and many other uses described in GE Plastics "LEXAN" film publication SP994 (5/87) RTB, which is incorporated herein by reference in its entirety for all purposes. LEXAN film 8B36 having a matte finish is recommended for use as a light defuser since it hides filaments and eliminates "hot spots" in backlit applications. The matte finish is recommended for dead front graphics because it offers reduced surface and gloss reflections. The suede surface is recommended for use in very heavy wear applications because it stands up to tough usage and resists abrasion while maintaining an attractive appearance. General Electric LEXAN polycarbonate films technical manual SP-811 (4/83) JF discloses printing processes recommended for printing on LEXAN films. Designs are typically formed by printing on the smooth or polished side of the film.

The General Electric Product Code explanation indicates that "Lexan" polycarbonate film having surface texture designated "8B36" has a "matte" surface texture on one side of the film and a "suede" surface texture on the other side. In the list of surface textures, "matte" is slightly rougher than a "polish" surface finish. A "suede" surface texture is listed as being less textured than "leatherette" but rougher than "matte" and "velvet" surface textures.

Thus, a "matte" textured surface finish is smoother than a "suede" textured surface finish.

The surface texture range from "polish" to "woodtick" progresses in surface roughness. "Polished" surface texture is virtually defect-free. A sheet having a "smooth" surface texture is not as smooth as a "polished" surface texture. A "matte" surface texture is not as smooth as a "smooth" surface texture and diffuses light. The "matte" surface texture is relatively smooth but offers reduced surface and gloss reflections to the surface of the material. A "velvet" surface texture is slightly rougher than the "matte" surface texture and has sufficient roughness to hide scratches, fingerprints and marring. The "suede" surface texture is rougher than a "matte" or a "velvet" surface texture but is smoother than "leatherette" and "woodtick" surface textures.

Figure 4:
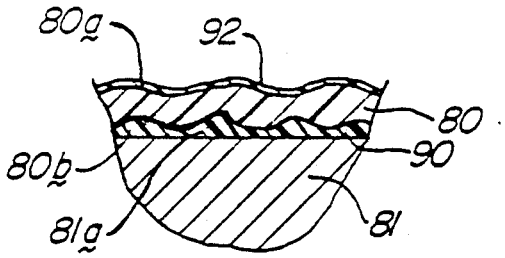
FIG. 4 is an enlarged cross-sectional view of a transfer cylinder surface.

Referring to FIG. 4 of the drawing, sheets 80 of LEXAN film are bonded to surfaces of each transfer cylinder 80–89. The sheet of LEXAN film is cleaned with alcohol and scrubbed with a detergent and water in preparation for bonding. After the LEXAN sheet dries, a solution of fabric softener, water and silicone is rubbed onto the "matte" finished surface and it is stretched out on a flat horizontal surface and allowed to dry. The fabric softener and silicone form a film which eliminates static electricity.

The surface of each transfer cylinder is degreased and cleaned by a suitable solvent such as acetone or ketone. A thin layer 90 of adhesive is applied, as by spraying onto the surface of the transfer cylinder. The film 80 is then attached to the surface of the transfer cylinder with the "suede" finished surface 80*b* adjacent the roller surface 81*a* such that the "matte" finished surface 80*a* of the film 80 is on the outside. The "suede" surface finish on the underside of the film enhances the bonding characteristics of the adhesive.

As illustrated in FIG. 4 of the drawing, transfer cylinder 81 has an outer surface 81*a* to which a layer 90 of adhesive is applied for bonding the lower surface 80*b* of sheet 80 of LEXAN film to transfer cylinder 81. The outer surface 80*a* of sheet 80 of film is cleaned with alcohol or a mild blanket wash and a thin film 92 of silicone spray is applied. A suitable silicone spray is available from Varn Products Company, Inc. of Oakland, N.J. The silicone spray forms a slippery, long-lasting silicone film that repels water, ink, grease, rust and glue and provides a corrosion resistant film.

Silicone spray has been used heretofore on impression, blanket and plate cylinders; on press and folder feed boards, belts and feed and delivery wheels. Silicone spray is often used on cutting tables and blades, saws, shelving, conveyors and the like to provide slip and to reduce friction.

The surface of the LEXAN film treated to eliminate static electricity and coated with a silicone film is easily cleaned to remove any accumulation of ink which may be deposited thereon with a light blanket wash. After the surface has been cleaned it should be sprayed with silicone to replenish the coating and to assure that no pin holes penetrate the protective coating.

I claim:

1. A transfer cylinder for a printing press comprising: a film of polycarbonate bonded to the surface of the transfer cylinder, said film having a roughened surface on one side and a matte finished surface on the other side, said roughened surface being bonded to the surface of said transfer cylinder; and a film of silicone on the matte finished surface of said film forming an ink repellant surface.

2. A sheet transfer mechanism comprising: sheet gripper means; means to move the gripper means along a curved path about an axis; a sheet guide member rotating about said axis; an arcuate guide surface having a leading edge and a trailing edge on said guide member; a vane having a leading edge and a trailing edge spaced from said leading and trailing edges of said guide surface, said vane being positioned relative to said guide surface to form a chamber having an entrance opening between said leading edges and having an air dispensing passage between said trailing edges; means rotating said sheet guide member in synchronized relation to said gripper means to guide a printed sheet along said path; a matte surface finished film of polycarbonate material on said guide surface; and a silicone film on said polycarbonate to provide an ink rejecting surface.

3. A method of forming an ink rejecting surface on a sheet transfer member comprising the steps of: providing a sheet of polycarbonate material having a textured surface finish on at least one surface; forming a film on the textured surface to eliminate static electricity; forming a slick ink-rejecting coating over the film; and securing the sheet of polycarbonate material to a sheet transfer member.

4. The method of claim 3, the step of forming a film on the textured surface to eliminate static electricity comprising: cleaning the sheet of polycarbonate material; applying a solution of fabric softener, water and silicone to the textured surface; and supporting the sheet on a flat horizontal surface while it is drying.

5. The method of claim 4, the step of securing the sheet of polycarbonate material to a sheet transfer member comprising the steps of: degreasing the surface of a sheet transfer member; applying a layer of adhesive material onto the surface of the transfer member; and positioning the sheet of polycarbonate material on the adhesive such that the textured surface on which the slick ink-rejecting coating is formed faces outwardly and is spaced from the surface of the sheet transfer member.

6. The method of claim 5, the step of forming a slick ink-rejecting coating over the film comprising the steps of: cleaning the textured surface finish on the sheet of polycarbonate material; and applying material to the textured surface formulated to repel water, ink, grease, rust and glue.

7. The method of claim 3, the step of forming a slick ink-rejecting coating over the film comprising the step of: coating the film with silicone.

8. A sheet transfer mechanism for a printing press comprising: a sheet guide member having a sheet guide surface; a sheet of plastic material having first and second surfaces, said second surface of said plastic sheet having a textured surface finish; means securing said plastic sheet to said sheet guide member such that said first surface is adjacent said sheet guide surface on said sheet guide member; and a slick ink-rejecting coating on said textured surface finished second surface of said plastic sheet.

9. A sheet transfer mechanism according to claim 8, said coating comprising: a first film on said textured surface to eliminate static electricity; and a second film over said first film forming the slick ink-rejecting coating.

10. A sheet transfer mechanism according to claim 9, said second film comprising: a continuous second film of silicon over said first film to assure that no pinholes penetrate the coating.

11. A sheet transfer mechanism according to claim 8, said first film comprising: fabric softener and silicon formulated to eliminate static electricity.

12. A sheet transfer mechanism according to claim 8, said plastic sheet comprising: a sheet of thermoplastic material.

13. A sheet transfer mechanism according to claim 8, said plastic sheet comprising: a sheet of polycarbonate material.

14. A sheet transfer mechanism according to claim 13, said textured surface having a matte surface texture.

15. A sheet transfer mechanism according to claim 8, said plastic sheet comprising: a sheet of polycarbonate material having a thickness in a range from 0.05 to 30 mils.

16. A sheet transfer mechanism according to claim 15, said ink-rejecting coating comprising: a first film over said matte finished surface formulated to eliminate static electricity; and a second film formulated to reject printing ink.

* * * * *